US006385779B2

(12) United States Patent
Boersema

(10) Patent No.: US 6,385,779 B2
(45) Date of Patent: May 14, 2002

(54) INFANT SOCK

(76) Inventor: Tasha Boersema, 683 Sleepy Hollow La., Holland, MI (US) 49423

( * ) Notice: Subject to any disclaimer, the term of this patent is extended or adjusted under 35 U.S.C. 154(b) by 0 days.

(21) Appl. No.: 09/894,736

(22) Filed: Jun. 28, 2001

Related U.S. Application Data

(60) Provisional application No. 60/214,377, filed on Jun. 28, 2000.

(51) Int. Cl.[7] ..... A41B 11/00

(52) U.S. Cl. ..... 2/239; 2/409; 36/9 R; 36/10

(58) Field of Search ..... 2/239, 409, 80, 2/83; 36/110–113, 136, 7.1 R, 72, 9 R, 9 A, 10, 70 R, 4

(56) References Cited

U.S. PATENT DOCUMENTS 266,614 A * 10/1882 Douglass ..... 2/239
2,725,567 A * 12/1955 Bevier ..... 2/83
4,069,515 A * 1/1978 Swallow et al. ..... 2/239
4,149,274 A * 4/1979 Garrou et al. ..... 2/239
4,294,022 A * 10/1981 Stockli et al. ..... 36/4
4,651,354 A * 3/1987 Petrey ..... 2/239
D322,881 S 1/1992 Bushman
5,204,996 A 4/1993 Ehmka
D347,518 S * 6/1994 Stewart ..... 36/9 R X
D375,616 S 11/1996 Baker et al.
5,617,585 A * 4/1997 Fons et al. ..... 2/239
5,708,985 A 1/1998 Ogden
5,737,776 A * 4/1998 Jennings ..... 2/409
5,926,888 A 7/1999 Chen et al.

* cited by examiner

*Primary Examiner*—Gloria M. Hale
(74) *Attorney, Agent, or Firm*—MacMillan, Sobanski & Todd, LLC

(57) ABSTRACT

An infant sock for crawling infants includes a generally tubular sock member having an upper surface, a lower surface, a toe surface forming a closed end, and an open end. An elastic band is attached at the open end receiving an infant's foot. A gripper member covers at least a portion of the upper surface, the lower surface and the toe surface and has an increased coefficient of friction.

13 Claims, 2 Drawing Sheets

INFANT SOCK

CROSS-REFERENCE TO RELATED APPLICATION

This application claims the benefit of U.S. provisional patent application Ser. No. 60/214,377 filed Jun. 28, 2000.

BACKGROUND OF THE INVENTION

The present invention relates generally to a sock for an infant and, in particular, to a sock designed to provide additional traction for a crawling infant.

Dressing an infant with fabric socks is advantageous in many ways. Socks are aesthetically pleasing, keep the infant's feet warm and protect the infant's feet from minor cuts and abrasions. When the infant becomes ambulatory, however, socks can be disadvantageous on smooth floor surfaces, such as hardwood or linoleum floors, because there is a very low coefficient of friction between fabric material of the socks and the floor surface. This poses an increased risk of injury because the infant may slip and fall on the smooth surface while wearing only the fabric socks. Dressing the infant with shoes is one solution to this problem, but it is not always desirable, and is often difficult, to put shoes on an ambulatory infant.

This is a recognized problem, and many prior art infants socks, therefore, have been fitted with material that provides greater traction on the bottom of the sock. This material is also referred to as a gripper area. These prior art socks have worked well for those infants who have already progressed to walking, because the portion of the sock with the gripper area is in contact with the smooth floor surface. These prior art socks, however, have been disadvantageous for crawling infants, because typically the feet of crawling infants contact the floor surface with portion of the foot closest to the toes or the top of the foot, rather than the bottom of the foot. Because the top portion of the prior art socks did not contain a gripper area on the toes or top of the sock, the same problems were encountered as with socks without any gripper area, which results in an increased risk of injury to crawling infants wearing the prior art socks.

It is desirable to provide an infant sock that will provide greater traction for crawling infants as well as for infants that are already walking.

It is an object of this invention, therefore, to provide an infant sock suitable for both crawling and walking infants with a decreased risk of injury to the crawling infant wearing the sock.

SUMMARY OF THE INVENTION

The present invention concerns an infant sock for use with a crawling infant. The infant sock includes a tubular sock member with an upper surface, a lower surface, and a toe portion connecting and enclosing the upper and lower surfaces at a leading edge of the sock member. At the opposite end of the tubular sock member, the upper surface and lower surface form an open end for receiving a foot. A gripper area is attached to the exterior portion of the sock member and preferably extends from the upper surface to the toe area and further to the lower surface. The gripper area is preferably a single piece of frictional material that covers an area along the lower surface, and a lesser area on the upper surface. The gripper is preferably attached to the fabric of the sock member by a thermal process. The sock member preferably includes an elastic member at the open end to keep the sock in place on the infant's foot and lower leg.

Alternatively, the sock member is advantageously foot-shaped for ease of dressing the infant.

Alternatively, the gripper area is formed in a tread pattern and can include transversely or circumferentially spaced ribs along the upper surface, toe portion, and lower surface.

The present invention recognizes that prior art socks were suitable neither for providing traction to crawling infants nor for reducing the risk of injury to crawling infants on smooth floor surfaces. With a gripper area at the top surface and toe portion of the sock member, the present invention provides infants wearing the present invention a greater ability to crawl on smooth surfaces, while reducing the risk of injury to crawling infants. The present invention is also suitable for infants who have progressed to walking, because the gripper area extends to the lower surface of the sock member.

The present invention is a novel improvement over the prior art because while the prior art teaches many different varieties of infant socks, none of the prior art teaches an infant sock with a gripper area extending to the toe and the upper surface of the sock member for the purpose of providing traction to crawling infants.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
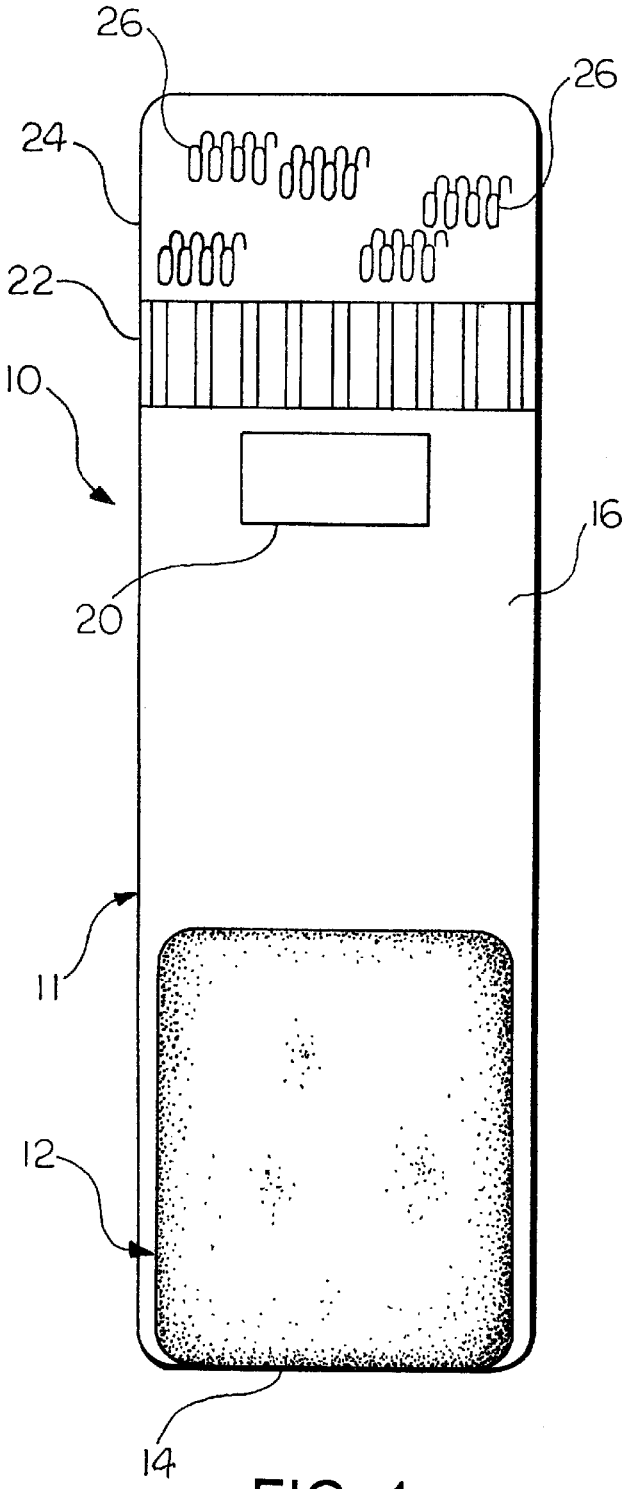
FIG. 1 is a bottom view of an infant sock in accordance with the present invention.
Figure 2:
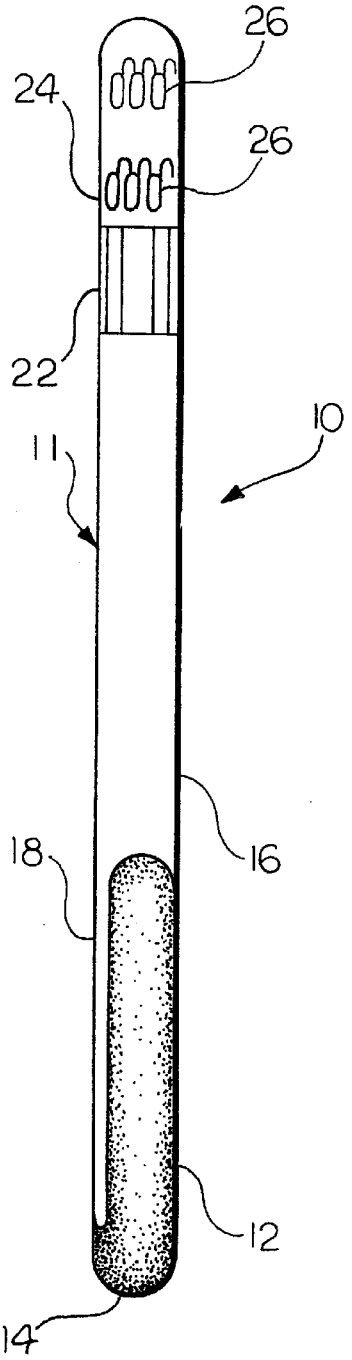
FIG. 2 is a side view of the infant sock in FIG. 1.

Referring now to FIGS. 1 and 2, an infant sock is shown generally at 10. The infant sock 10 includes a generally tubular sock member 11. The sock member 11 includes an upper surface 18, a lower surface 16, and a toe surface 14 on the exterior thereof The toe surface 14 defines an enclosed end of the sock member 11 opposite an open end for receiving an infant's foot (not shown). The sock member 11 is preferably constructed of a natural fabric material, such as cotton, or a synthetic fabric material, such as Lycra or spandex, or a combination of such materials. Preferably the infant sock 10 is latex free. The upper surface 18 and the lower surface 16 preferably consist of the same amount of fabric material so as to ensure a good fit on an infant's foot (not shown.) The infant sock 10 is preferably sized to fit an infant learning to crawl. A typical age for such an infant is about four months of age to about one year of age.

A gripper member 12 is adhered to the lower surface 16, the upper surface 18, and the toe surface 14. Preferably the gripper member 12 covers a continuous area of the sock member 11 extending from a seam on the upper surface 18 (not shown) at the toe surface 14 to a front-to-mid section of the lower surface 16 of the sock member 11. The area covered by the gripper member 12 on the lower surface 16 is preferably greater than the area covered by the gripper member 12 on the upper surface 18. The gripper member 12 preferably covers most of the area of the toe surface 14. Alternatively, the gripper member 12 covers a greater area on the upper surface 18 than on the lower surface 16. The gripper member 12 is preferably constructed of a material that increases the coefficient of friction with a floor surface, such as a rubberized material or the like, having a coefficient of friction greater than a coefficient of friction of the material from which the sock member 11 is made. The material of the gripper member 12 is flexible and withstands laundering. The material of the gripper member 12 may be adhered to the sock member 11 by a thermal process, such as an applique process.

The sock member 11 also includes an annular elastic band 22 attached to the upper surface 18 and lower surface 16 that forms the open end for receiving the infant's foot. The elastic band 22 also aids in keeping the sock member 11 in place on the infant's lower leg (not shown.) The elastic band 22 preferably includes a fabric sheath for comfort. A tubular entrance band 24 is attached to the elastic band 22. The entrance band 24 is preferably constructed of the same material as the sock member 11 and may include a typical knitting pattern 26. The knitting pattern 26 preferably consists of multiple parallel ribs of knitted fabric that may be folded towards the toe surface 14 as desired for aesthetic purposes. The sock member 11 also includes an emblem or similar indicia 20 on the lower surface 16. The emblem 20 may be constructed of the same material as the gripper member 12. Alternatively, the emblem 20 is attached to the upper surface 18 or to the entrance band 24.

Figure 3:
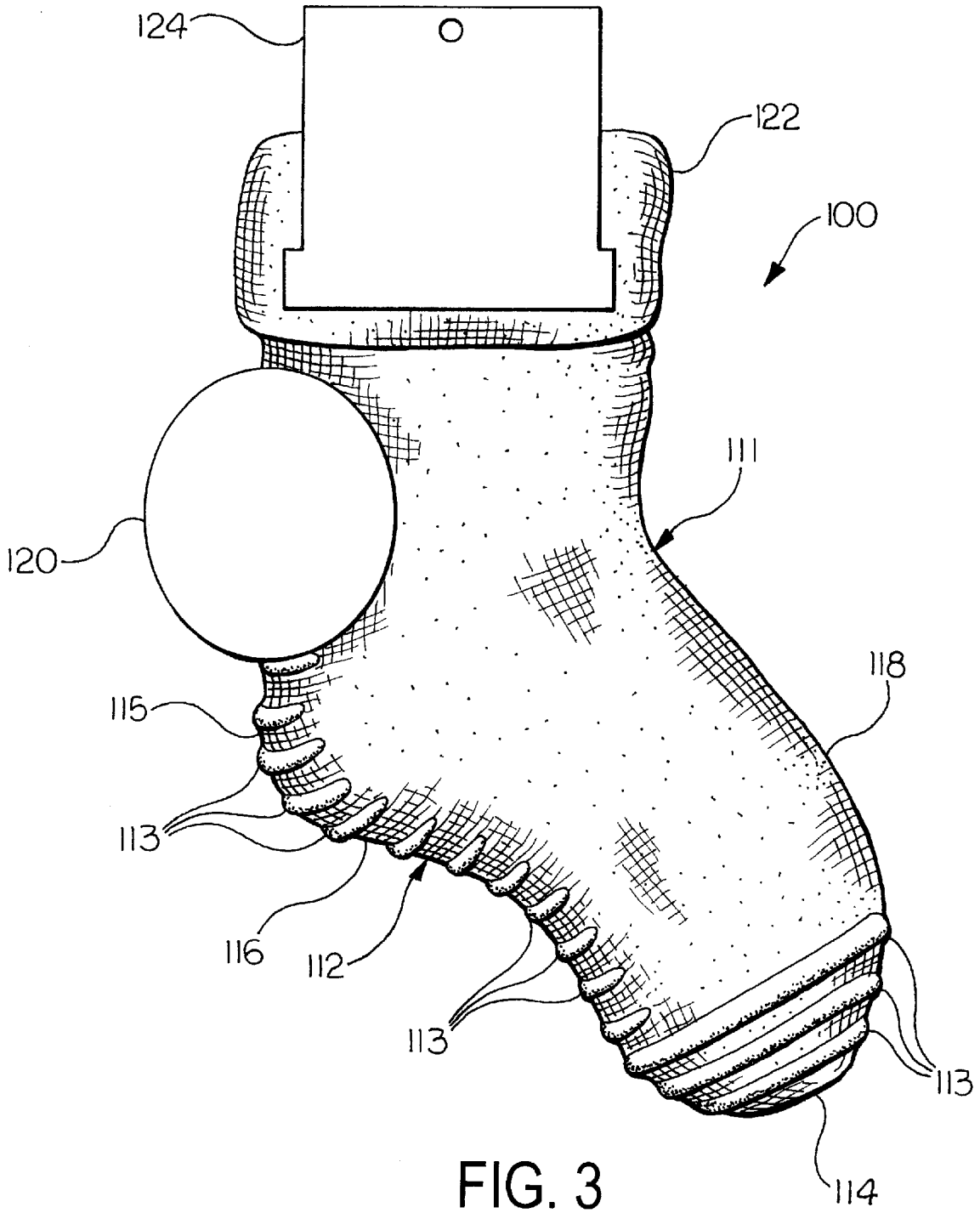
FIG. 3 is a perspective view of an alternative embodiment of an infant sock in accordance with the present invention.

Referring now to FIG. 3, an alternative embodiment of an infant sock is shown generally at 100. The infant sock 100 includes a generally foot-shaped sock member 111. The sock member 111 includes an upper surface 118, a lower surface 116, and a toe surface 114. The toe surface 114 forms an enclosed end of the upper surface 118, and the lower surface 116. The sock member 111 is preferably constructed of a natural fabric material, such as cotton, or a synthetic fabric material, such as Lycra or spandex, or a combination of such materials. Preferably the infant sock 100 is latex free. The infant sock 100 is preferably sized to fit an infant learning to crawl. A typical age for such an infant is about four months of age to about one year of age.

A gripper member 112 is adhered to the lower surface 116, the upper surface 118, and the toe surface 114. The gripper member 112 can be formed as a tread pattern composed of a series of spaced ribs 113 extending transverse to a length of the sock member 111. The ribs 113 may be spaced along the lower surface 116, and may extend to the upper surface 118, and the toe surface 114. Preferably the gripper member 112 covers an area of the sock member 111 extending from a seam on the upper surface 118 (not shown) at the toe surface 114 to a front-to-mid section of the lower surface 116 of the sock member 111. The area covered by the gripper member 112 on the lower surface 116 is preferably greater than the area covered by the gripper member 112 on the upper surface 118, and the gripper member 112 may extend back to a heel portion 115 of the sock member 111. The gripper member 112 preferably covers most of the fabric material of the toe surface 114. The transverse ribs 113 on the toe surface 114 may extend completely around the circumference of the toe surface 114. The gripper member 112 is preferably constructed of a material that increases the coefficient of friction between two materials, such as a rubberized material or the like. The material of the gripper member 112 is flexible and withstands laundering. The material of the gripper member 112 may be adhered to the sock member 111 by a thermal process, such as an applique process.

The sock member 111 also includes a tubular elastic band 122 for receiving the infant's foot that also aids in keeping the sock member 111 in place on the infant's lower leg (not shown.) The elastic band 122 preferably contains a fabric sheath for comfort. An emblem or similar indicia 120 can be affixed to the sock member 111. The emblem 120 may be constructed of the same material as the gripper member 112. A packaging tab 124 can be attached to the sock member 111 as desired.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An infant sock for crawling infants comprising:

a sock member sized to fit a foot of an infant learning to crawl, said sock member having an exterior upper surface and an exterior lower surface extending between an open end and a closed end, said closed end having an exterior toe surface; and a gripper member connected to said sock member, said gripper member covering at least a portion of each of said exterior upper surface, said exterior lower surface and said exterior toe surface, said gripper member having a coefficient of friction greater than a coefficient of friction of any of said exterior surfaces of said sock member whereby said gripper member covering at least one of said at least a portion of said exterior upper surface and said exterior toe surface provides increased traction to an infant crawling on a smooth surface.

2. The infant sock according to claim 1 wherein said sock member has a tubular shape.

3. The infant sock according to claim 1 wherein said sock member has a foot shape.

4. The infant sock according to claim 1 wherein said gripper member does not extend beyond a front-to-mid section of said exterior lower surface of said sock member.

5. The infant sock according to claim 1 wherein said gripper member is formed from a rubberized material.

6. The infant sock according to claim 1 wherein said gripper member is adhered to said sock member by a thermal process.

7. The infant sock according to claim 1 wherein said gripper member is a continuous member.

8. The infant sock according to claim 1 wherein said gripper member has a plurality of spaced apart ribs extending transverse to a length of said sock member.

9. The infant sock according to claim 8 wherein at least one of said ribs extends around a circumference of said exterior toe surface.

10. The infant sock according to claim 1 including an elastic band attached adjacent said open end of said sock member.

11. The infant sock according to claim 1 including an entrance band attached at said open end of said sock member.

12. An infant sock for crawling infants comprising:

a sock member sized to fit a foot of an infant learning to crawl, said sock member having an exterior upper surface and an exterior lower surface extending between an open end and a closed end, said closed end having an exterior toe surface;

a gripper member connected to said sock member, said gripper member covering at least a portion of each of said exterior upper surface, said exterior lower surface and said exterior toe surface, said gripper member having a coefficient of friction greater than a coefficient of friction of any of said exterior surfaces of said sock member; and at least one rib formed on said gripper member and extending around a circumference of said exterior toe surface.

13. An infant sock for crawling infants comprising:

a sock member sized to fit a foot of an infant learning to crawl, said sock member having an exterior upper surface and an exterior lower surface extending between an open end and a closed end, said closed end having an exterior toe surface;

an elastic band attached adjacent said open end of said sock member; and a gripper member connected to said sock member, said gripper member covering at least a portion of each of said exterior upper surface, said exterior lower surface and said exterior toe surface, said gripper having a coefficient of friction greater than a coefficient of friction of any of said exterior surfaces of said sock member whereby said gripper member covering at least one of said at least a portion of said exterior upper surface and said exterior toe surface provides increased traction to an infant crawling on a smooth surface.

* * * * *